United States Patent [19]

Voland et al.

[11] Patent Number: 4,485,281

[45] Date of Patent: Nov. 27, 1984

[54] PUSH TO START TIMING MECHANISM

[75] Inventors: Elmo W. Voland, Indianapolis; George W. Adams, Greenwood; Steven W. Smock, Indianapolis, all of Ind.

[73] Assignee: Emhart Industries, Inc., Indianapolis, Ind.

[21] Appl. No.: 471,535

[22] Filed: Mar. 2, 1983

[51] Int. Cl.[3] ..... H01H 43/10

[52] U.S. Cl. ..... 200/38 R; 200/38 F; 200/38 B

[58] Field of Search ..... 200/27 R, 27 B, 27 BA, 200/30 R, 31 R, 33 R, 35 R, 38 R, 38 A, 38 F, 38 B, 38 BA, 38 C, 38 CA, 39 R

[56] References Cited

U.S. PATENT DOCUMENTS

| | | | |
|---|---|---|---|
| 3,150,241 | 9/1964 | Goodhouse et al. | 200/38 F |
| 3,700,837 | 10/1972 | Schulze-Berge | 200/38 BA X |
| 3,823,280 | 7/1974 | Obermann et al. | 200/38 B |
| 4,123,915 | 11/1978 | Stoor | 200/38 B X |
| 4,246,454 | 1/1981 | Ray | 200/38 F |
| 4,415,785 | 11/1983 | Uno et al. | 200/39 R X |

*Primary Examiner*—J. R. Scott

*Attorney, Agent, or Firm*—Robert F. Meyer

[57] ABSTRACT

A timing mechanism is started by pushing a plunger against a cam assembly to disengage a cam from a switch to allow the switch to close. The cam assembly is axially spring biased against a wall of the timing mechanism to stop its movement after the switch closes. The plunger is axially spring biased against the cam assembly to permit it to proceed and override the cam assembly to prevent jamming of the plunger or other elements of the timing mechanism until a stop prevents continued movement of the plunger.

8 Claims, 5 Drawing Figures

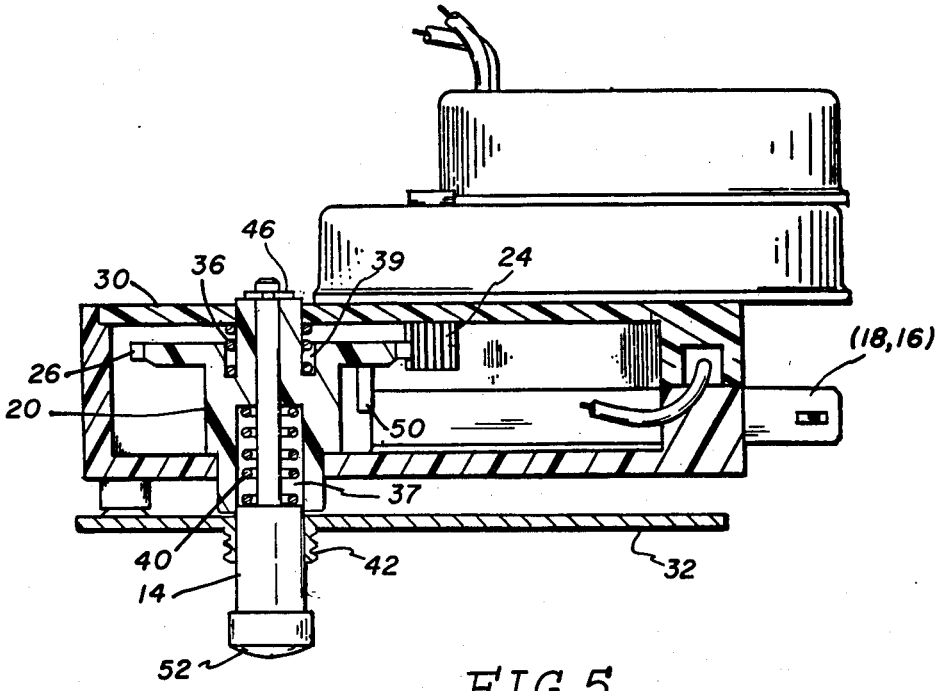
FIG.5
FIG.4
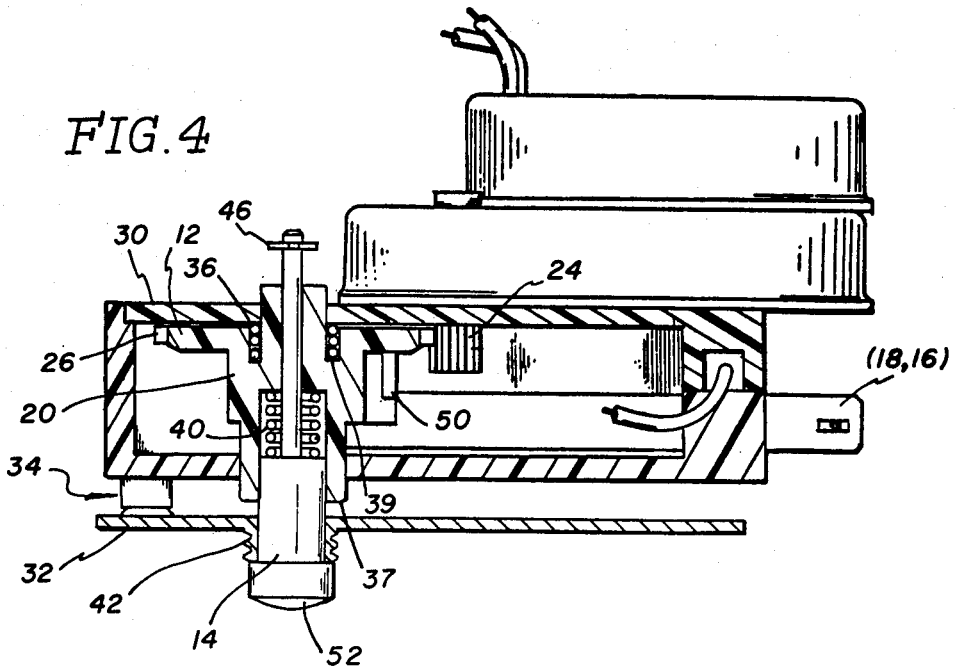

PUSH TO START TIMING MECHANISM

BACKGROUND OF THE INVENTION

Generally speaking, the present invention pertains to a timing mechanism which comprises a housing, a motor drive means including an output member, an axially spring biased combination cam and gear assembly independently carried on an axially spring biased plunger extending through the housing, the gear engaging the output member; a switch means normally biased in an open position by the cam; first stop means limiting an axial movement of the combination; and second stop means limiting an axial movement of the plunger; initial axial movement of the plunger causing movement of the combination causing the cam to permit the switch means to close, continued movement causing the combination to engage the first stop means and additional continued movement causing the plunger to engage the second stop means.

The present invention relates to a timing mechanism and more particularly to a timing mechanism having a push-to-start mechanism.

Timing mechanisms have long been known in the art for controlling functions to appliances such as washers, dryers and hand dryers, for example. The present invention is particularly concerned with timing mechanisms for hand dryers used in public rest rooms. In such applications, the user pushes in on a knob to start the timing mechanism which controls the length of time warm air is supplied to the user. It has been found that in such applications rough handling of the dryer causes jamming of the timing mechanism. More particularly, it has been found that the user "slams" the knob in a rough manner to cause jamming of the timing mechanism. The present invention is directed to overcoming this problem.

FEATURES OR OBJECTS OF THE INVENTION

It is a feature of the present invention to provide a timing mechanism that is particularly adaptable for public hair dryers. Another feature of the invention is to provide such a timing mechanism having a push-to-start mechanism with an override feature. Another feature of the invention is to provide such a timing mechanism having an axially spring biased combination cam and gear assembly independently carried on an axially spring biased plunger extending through a housing for the timing mechanism. Another feature of the invention is to provide such a timing mechanism wherein an initial axial movement of the plunger causes movement of the combination to permit the cam to close a switch with continued movement of the plunger being permitted after the switch has been closed. Yet another feature of the invention is to provide such a timing mechanism wherein the plunger is permitted to move through a housing for the mechanism to provide the override feature. These and other features of the invention will become apparent from the following description taken in conjunction with the accompanying drawings.

DESCRIPTION OF THE DRAWINGS

FIG. 4 is a view taken along the line 4—4 of FIG. 2 showing another view of the operating position shown in FIG. 2.

FIG. 5 is a view taken along the line 5—5 of FIG. 3 showing another view of its operating position.

DETAILED DESCRIPTION OF THE INVENTION

Figure 1:
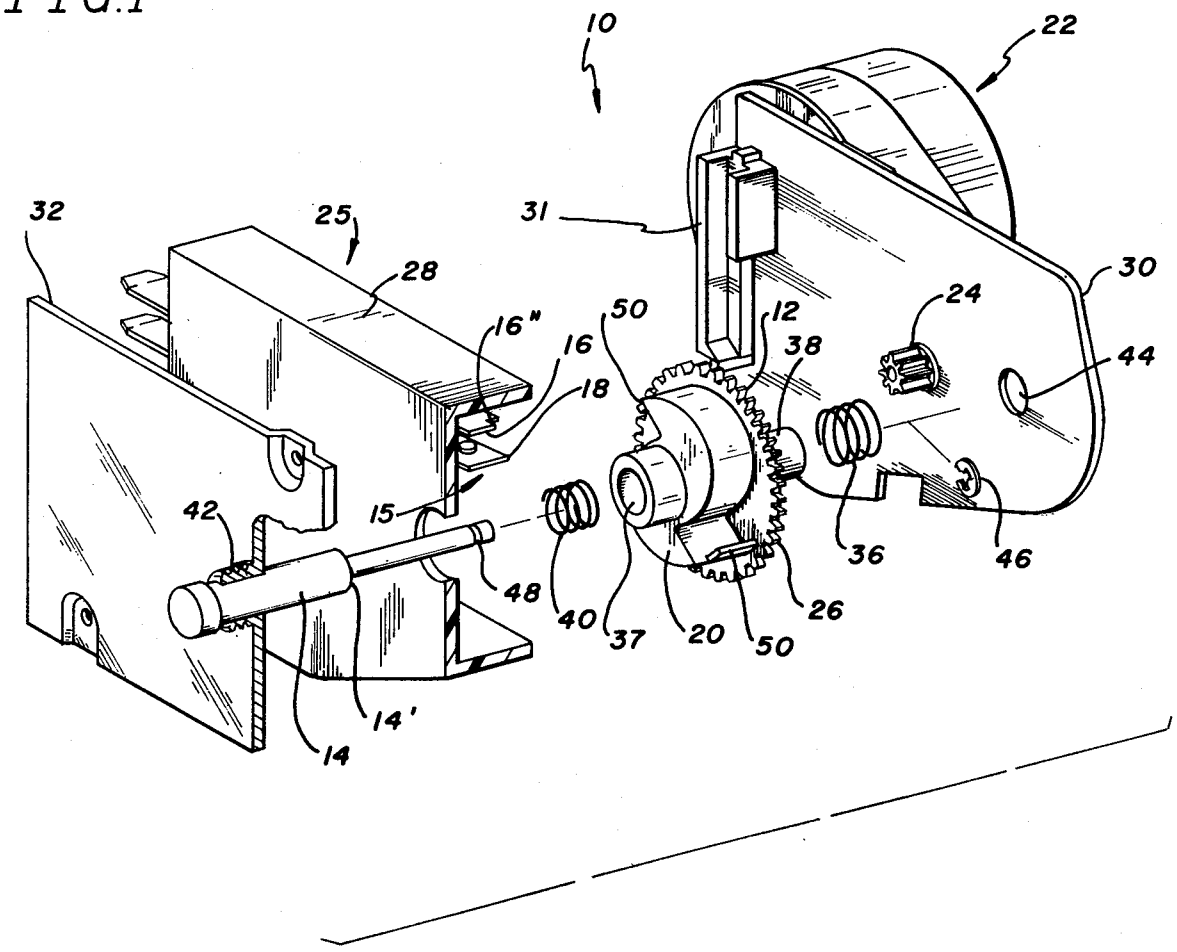
FIG. 1 is an exploded view of a timing mechanism showing the features of the present invention.

Referring now to the drawings, there is shown a timing mechanism 10 employing the features of the invention. Timing mechanism 10, in general, includes a combination cam and gear assembly 12 which is independently carried on a plunger 14, switch means 15, and motor drive means 22 which applies power driven rotation to the cam and gear assembly through an output pinion 24 which engages gear 26. Switch means 15 includes movable blades 16 and 18 having electrical contacts 16' and 18'. As shown, the blades engage cam 20 to open and close the electrical contacts. The elements of the timing mechanism are carried within a housing 25 which includes cup-shaped member 28 that is closed by a cover plate 30. Cover 30 includes a terminal block 31 for receiving lead wires. In its application in a hand dryer, the timing mechanism is mounted on a suitable frame member 32 through a mounting means 34 (FIG. 4).

The combination cam and gear assembly 12 is axially spring biased through a coil spring 36 which is mounted in an annular cavity 39 of hub 38 between the combination cam and gear assembly 12 and cover plate 30. Plunger 14 is axially spring biased through a coil spring 40 which is carried on the plunger 14 inside cavity 37 of hub 38 between cam 20 and a shoulder 14' of the plunger.

Plunger 14 axially moves within bushing 42 and hub 38 and extends through hub 38 to extend outside the housing. E-clamp 46 tightly fits in groove 48 of the plunger to prevent it from receding completely into the housing.

Figure 2:
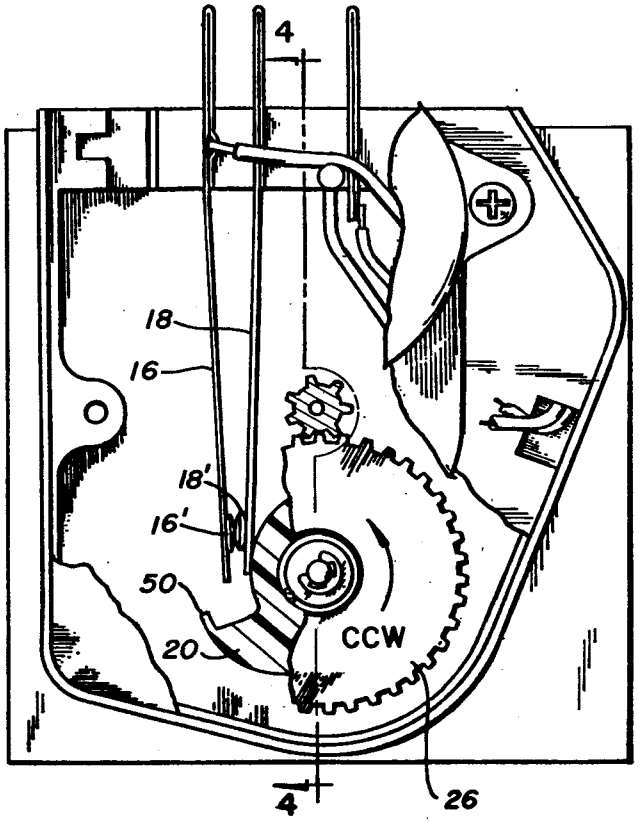
FIGS. 2 and 3 are side elevations of the timing mechanism showing different operating modes of the timing mechanism.
Figure 3:
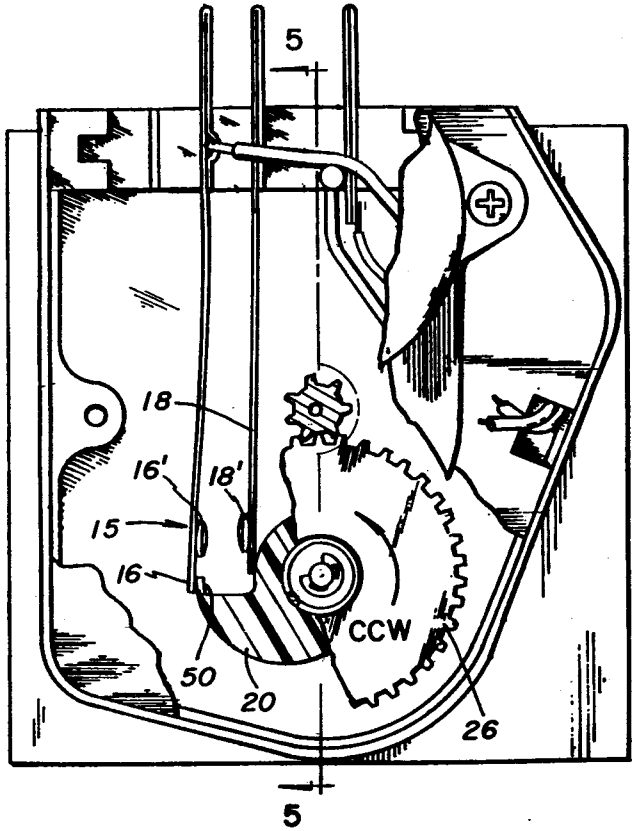

Referring now to FIGS. 2–5, the operation of the timing mechanism can be described. Referring to FIGS. 3 and 5, switch 15 is biased in a normally open position. In this position, blade 16 rides on the outer lip 50 of cam 20 with the inner blade 18 riding on the inner periphery of the cam. As shown, there are two oppositely disposed lips 50 and each lip is a partial lip in that they do not extend across the full thickness of the cam. In this switch position plunger 14 is as shown in FIG. 5, biased out by coil spring 40. Referring to FIGS. 2 and 4, to start the timing mechanism and the hand dryer, plunger 14 is depressed in such that blade 16 drops past the lip 50 through a notch 16'' (FIG. 1) of the blade to close contacts 16' and 18' of the switch. Cam 20 will rotate counter clockwise and the timing mechanism will now complete its cycle. As shown in FIG. 3, blade 18 drops from lip 50 while blade 16 remains on the lip because blade 16 is slightly longer. The switch is now in its normally biased open position.

With reference to FIG. 4, when plunger 14 is depressed, the combination cam and gear assembly 12 bottoms out or is stopped by the force of coil spring 36 acting against cover plate 30. In situations where the user is not careful and jams the plunger hard against the cover plate, the timing mechanism could be locked or otherwise damaged. This problem has been overcome by permitting the plunger to override the combination cam and gear assembly. Thus, as shown in FIG. 4, plunger 14 is permitted to proceed by spring 40 until a knob 52 of the plunger butts against bushing 42.

What is claimed is:

1. A timing mechanism comprising (a) a housing, (b) a motor drive means including an output member, (c) an axially spring biased combination cam and gear assembly independently carried on an axially spring biased plunger extending through said housing, said gear engaging said output member, (d) a switch means normally biased in an open position by said cam, (e) first stop means limiting an axial movement of said combination, and (f) second stop means limiting an axial movement of said plunger, initial axial movement of said plunger causing axial movement of said combination cam and gear assembly to axially displace said cam to permit said switch means to close, continued axial movement causing said combination cam and gear assembly to engage said first stop means, and additional continued axial movement causing said plunger to engage said second stop means.

2. A timing mechanism according to claim 1 wherein said first stop means includes a wall of a housing for said timing mechanism.

3. A timing mechanism according to claim 1 wherein said second stop means includes a knob at an end of said plunger engaging a bushing carrying said plunger.

4. A timing mechanism according to claim 1 wherein said combination cam and gear assembly is axially spring biased by a coil spring carried between said combination cam and gear assembly and a wall of a housing for said timing mechanism.

5. A timing mechanism according to claim 1 wherein said plunger is spring biased by a coil spring carried on said plunger between said combination cam and gear assembly and a shoulder of said plunger.

6. A timing mechanism according to claim 1 wherein said cam includes at least one partial lip adapted to mate a notch in a distal end of a blade of said switch means.

7. A timing mechanism according to claim 6 wherein there are two oppositely disposed lips.

8. A timing mechanism according to claim 6 wherein there are two blades of said switch means, the outer blade of which is slightly longer.

* * * * *